US009127516B2

(12) United States Patent
Roodenburg et al.

(10) Patent No.: US 9,127,516 B2
(45) Date of Patent: Sep. 8, 2015

(54) DRILLING INSTALLATION AND OFFSHORE DRILLING VESSEL WITH DRILLING INSTALLATION

(75) Inventors: Joop Roodenburg, Delft (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 152 days.

(21) Appl. No.: 13/996,454

(22) PCT Filed: Dec. 20, 2011

(86) PCT No.: PCT/NL2011/050863

§ 371 (c)(1),
(2), (4) Date: Jul. 16, 2013

(87) PCT Pub. No.: WO2012/087119

PCT Pub. Date: Jun. 28, 2012

(65) Prior Publication Data

US 2013/0284450 A1 Oct. 31, 2013

(30) Foreign Application Priority Data

Dec. 23, 2010 (NL) ..... 2005912

(51) Int. Cl.
*E21B 15/02* (2006.01)
*E21B 19/14* (2006.01)
*E21B 19/00* (2006.01)

(52) U.S. Cl.
CPC ..... *E21B 19/143* (2013.01); *E21B 15/02* (2013.01); *E21B 19/002* (2013.01)

(58) Field of Classification Search
CPC ..... E21B 15/02; E21B 19/002; E21B 19/143
USPC ..... 166/352, 358; 175/52; 405/195.1, 196, 405/211; 414/22.51, 22.63
See application file for complete search history.

(56) References Cited

U.S. PATENT DOCUMENTS 3,789,921 A * 2/1974 DeChassy et al. ..... 166/351
4,629,014 A * 12/1986 Swisher et al. ..... 175/220

(Continued)

FOREIGN PATENT DOCUMENTS

WO WO 8801008 A1 * 2/1988 ..... E21B 19/15
WO WO 97/42393 A1 11/1997

(Continued)

*Primary Examiner* — Matthew Buck
(74) *Attorney, Agent, or Firm* — Birch, Stewart, Kolasch & Birch, LLP

(57) ABSTRACT

A dual firing line drilling installation has a drilling tower main structure with four frameworks that are each over a major portion of their height U-shaped in horizontal cross-section. A four-sided central (11) space is present, and along each side of the central space one framework is arranged with its opened vertical side facing the central space. First and second storage devices (25,27) are provided for vertically storing drilling tubulars. The first storage device is housed in a first framework, the second storage device in a second framework. A first hoisting device is supported by a third framework of the drilling tower main structure, to manipulate a string of drilling tubulars in a first firing line (21). A second hoisting device is supported by a fourth framework to manipulate a string of drilling tubulars in a second firing line (23). A first and second pipe racker (29,31) are housed within the drilling tower main structure and adapted to move drilling tubulars while supported in vertical orientation between a storage devices and a firing line.

33 Claims, 3 Drawing Sheets

(56) References Cited

U.S. PATENT DOCUMENTS

| | | | | |
|---|---|---|---|---|
| 4,762,185 | A * | 8/1988 | Simpson | 175/5 |
| 4,862,973 | A * | 9/1989 | Voigts et al. | 175/52 |
| 4,899,682 | A * | 2/1990 | Pouget et al. | 114/264 |
| 5,647,443 | A * | 7/1997 | Broeder | 175/5 |
| 6,047,781 | A * | 4/2000 | Scott et al. | 175/5 |
| 6,321,675 | B1 * | 11/2001 | Dybdahl et al. | 114/264 |
| 6,591,904 | B2 * | 7/2003 | Cicognani | 166/77.51 |
| 6,601,649 | B2 * | 8/2003 | Beato et al. | 166/352 |
| 6,763,898 | B1 * | 7/2004 | Roodenburg et al. | 175/7 |
| 6,766,860 | B2 * | 7/2004 | Archibald et al. | 166/341 |
| 7,628,225 | B2 * | 12/2009 | Petersson et al. | 175/5 |
| 8,052,369 | B2 * | 11/2011 | Often et al. | 414/22.55 |
| 8,425,171 | B2 * | 4/2013 | Mortensen et al. | 414/22.66 |
| 8,733,472 | B2 * | 5/2014 | Magnuson | 175/7 |
| 2010/0300697 | A1 * | 12/2010 | Wijning et al. | 166/352 |

FOREIGN PATENT DOCUMENTS

| | | | |
|---|---|---|---|
| WO | WO 0218742 | A1 * | 3/2002 |
| WO | WO 2010/126357 | A1 | 11/2010 |

* cited by examiner

DRILLING INSTALLATION AND OFFSHORE DRILLING VESSEL WITH DRILLING INSTALLATION

The invention relates to a drilling installation for drilling a well, for example an oil, gas, or a thermal well, by means of said installation, e.g. a subsea well. The invention also relates to an offshore drilling vessel equipped with such a drilling installation.

Well drilling installations are known in a variety of embodiments and often have a drilling tower of square or rectangular horizontal cross-section with a leg at each corner, the legs being interconnected by a network of struts so that a lattice-type main structure is obtained. For example in WO97/42393 a drilling vessel is shown having such a square cross-section tower, wherein two firing lines extend within the contour of the tower. For each firing line a hoisting device is present, as well as a pipe racker that allows to move drilling tubulars between the firing line and a storage device also housed within said tower.

Known dual firing line drilling installations of this type are not entirely satisfactory, e.g. as concerns their structural design and their operation, as well as reliability.

It is an object of the invention to provide an improved drilling installation.

This object is achieved by a dual firing line drilling installation for drilling a well, for example an oil, a gas, or a thermal well, by means of said installation, which installation comprises:

- a drilling tower main structure having four frameworks that are each over a major portion of their height U-shaped in horizontal cross-section, so that each of said frameworks has an opened vertical side, wherein a four-sided central space is present in the tower, and wherein along each side of the central space one of said four frameworks is arranged with its opened vertical side facing the central space, the frameworks being interconnected to form said drilling tower main structure,
- a first storage device for vertically storing drilling tubulars, said first storage device being housed in a first framework of the drilling tower main structure;
- a second storage device for vertically storing drilling tubulars, said second storage device being housed in a second framework of the drilling tower main structure which is located generally opposite from the first framework of the drilling tower main structure,
- a first hoisting device supported by a third framework of the drilling tower main structure, which first hoisting device is adapted to manipulate a string of drilling tubulars in a first firing line extending vertically within said third framework;
- a second hoisting device supported by a fourth framework of the drilling tower main structure, which fourth framework is located generally opposite from the third framework of the drilling tower main structure, and which second hoisting device is adapted to manipulate a string of drilling tubulars in a second firing line extending vertically within said fourth framework;
- a first pipe racker housed within the drilling tower main structure and adapted to move drilling tubulars while supported in vertical orientation between at least one of the storage devices and at least the first firing line via said opened vertical sides of the respective frameworks;
- a second pipe racker housed within the drilling tower main structure and adapted to move drilling tubulars while supported in vertical orientation between at least the second storage device and at least the second firing line via said opened vertical sides of the respective frameworks.

This design occupies relatively little space, e.g. significantly less than the square tower main structure of WO97/42393, which is e.g. relevant if the installation is placed on an offshore drilling vessel, more importantly on a monohull drilling vessel where space is often problematic. Also the design allows for a relatively low weight of the main structure of the installation, which is also advantageous when used on a (monohull) drilling vessel. The design also allows for effective handling of drilling tubulars, using the two pipe rackers.

It will be appreciated that in an embodiment the central space is square or rectangular, so that the frameworks are generally at right angles to one another. Other shapes are also possible, e.g. the central space can be a trapezoid.

It will also be appreciated that the opened vertical side facing the central space has an opening with a height corresponding at least to the maximum height of the drilling tubulars to be moved between the storage device and the firing line, so that these drilling tubulars can be moved in vertical orientation. For example said drilling tubulars are double or triple joint stands, thereby requiring a minimum height of said opening of 20 or 30 meters.

Preferably the first and second pipe racker are arranged in the central space, but in an alternative embodiment they could e.g. be housed at a corner of a framework housing a storage device and an adjacent framework in which a firing line extends.

Preferably each pipe racker includes a vertical column member that supports one or more gripping members, preferably each gripping member being supported on the column via a movable arm.

Preferably the first pipe racker is configured to move drilling tubulars while in vertical orientation between each of the first and second storage devices and each of the first and second firing lines, and the second pipe racker is configured to move drilling tubulars while in vertical orientation between each of the first and second storage devices and each of the first and second firing lines. In this embodiment, when one of the storage devices and/or one of the pipe rackers malfunctions, the other storage device and/or pipe racker are able to continue the operation while e.g. repairs are made.

In a practical embodiment the first and second framework have a height that is less than the height of the third and fourth framework, and a roof structure above the central space bridges the top ends of the first and second frameworks.

Preferably at least one of the third and fourth frameworks is provided with a vertically movable working floor having an opening therein for the string of drilling tubulars in the respective firing line, preferably said working floor being movable between a lowered and a raised position that are at least 5 meters apart. An advantage of this embodiment is that by moving the working floor upwards, the working floor can make way for other equipment to be positioned in the corresponding firing line, e.g. a blow-out preventer (BOP) or Christmas tree.

Preferably the framework is provided with vertical guide elements, e.g. rails, to guide the vertically movable working floor, e.g. the floor having sets of rollers cooperating with a rail.

Preferably at least one of the third and fourth frameworks is provided with one or more vertical guide elements, e.g. rails, and one or more trolleys that are movable along said guide elements, said one or more trolleys supporting a topdrive for rotary drive of a string of drilling tubulars and/or a travelling block for attaching a string of drilling tubular to the respective hoisting device.

In an embodiment of the third and/or fourth framework provided with one or more vertical guide elements, e.g. rails, it is preferred that said framework has a planar vertical side opposite the opened vertical side. The one or more vertical guide elements are mounted on said planar vertical side.

In a preferred embodiment the drilling tower main structure supports a weather protective cladding on its exterior to protect the work space near the first and second firing line, the first and second storage devices, and the central space from environmental weather conditions.

In an advantageous embodiment the first and second hoisting means each comprise a winch that is located in a separate room remote from the workspace near first and second firing lines and the central space.

An advantage is that the drilling installation can be used in harsh environments, e.g. the polar regions. Further, as the frameworks themselves support the weather protective cladding, no additional support structure for the cladding is required.

In an embodiment at least one the third and fourth framework has a V-door opening to allow for the passage of drilling tubulars, e.g. drill pipes and/or casing pipes, and/or riser.

For example it is envisaged that risers are handled at only one of the firing lines, and introduced into the tower via an opening in the corresponding third or fourth framework, e.g. the BOP being stored at said same side of the installation, e.g. the hoisting device at said side having a greater capacity than at the other side.

Preferably, the equipment for which a vertically mobile working floor can be raised is stored near the firing line inside the tower when not positioned in the corresponding firing line. Alternatively or additionally, one of the third and fourth frameworks comprises an opening to allow the passage of the equipment between a storage location outside the framework and the respective firing line inside the tower. Preferably, said opening is provided in the framework comprising said firing line.

In an embodiment, a mobile working floor is moveable along vertical guide elements of the corresponding third or fourth framework. These vertical elements thus guide the working floor as it is moving up and down. Preferably, the framework has a constant cross-section at least in the motion range of the working floor to accommodate the working floor in an appropriate manner.

In an embodiment, the frameworks support a weather protective cladding to protect the first and second firing line, the first and second storage device, and the central space from environmental weather conditions.

To further increase the level of redundancy, the first pipe racker is preferably also configured to move drilling tubulars between the first or second storage device and the second firing line, and the second pipe racker is preferably also configured to move drilling tubulars between the first or second storage device and the first firing line. In this way, in case one of the first or second pipe rackers is out of order the other one can take over to service both firing lines.

The U-shape of a framework may be composed of planar vertical sides, preferably parallel in vertical direction as well, preferably said planar side being at right angles. The U-shape could e.g. also be curved or partially curved, e.g. to follow the contour of a rotary storage device.

Preferably, the frameworks containing the first or second firing line are higher than the frameworks containing the first or second storage device. In this way, there is room above the firing line for components of the first and second hoisting means, such as sheaves, draw works, travelling blocks, load connectors, winches, etc., so that efficient use is made of the space.

In case the first and/or second hoisting means comprise a winch, the winch is preferably located outside the main tower structure, e.g. in a separate room. This reduces the chance of lighting gases inside the tower. Preferably, the winch is mounted on the outside of the tower, raised above deck level, so that the winch does not occupy floor space around the tower.

Drilling tubulars will have to be transported from outside the tower to inside the tower or vice versa. For that purpose, an opening should be provided in the tower to allow the passage of these drilling tubulars. However, in case the protective cladding is present, the opening should be as small as possible to retain the protection against the environmental weather conditions provided by the protective cladding. Further, a small opening will result in a more rigid tower than a large opening. This opening may be so small that drilling tubulars can only pass in a horizontal or inclined orientation, for instance a V-door. The opening is preferably near one of the firing lines, e.g. in the third and/or fourth framework, so that the corresponding first or second hoisting means may be used for transportation of the drilling tubulars through the opening and may automatically put them in a vertical orientation for further handling inside the tower.

In an embodiment, the first and second storage device are rotary storage devices, i.e. a carrousel type storage device, wherein the storage device is rotatable about a vertical axis and has storage slots, e.g. in a fingerboard, for storage of multiple drilling tubulars in a vertical orientation. Each storage device has a drive to rotate the storage device about its vertical axis. An advantage of such a storage device is that the orientation of the first and second pipe rackers can be substantially the same when taking drilling tubulars from the storage device by rotation of the storage device and presenting the tubular elements substantially in the same position to the pipe rackers. Control of the pipe rackers may therefore be relatively easy.

In an embodiment, the first and second pipe racker are moveable between an operative position near the first firing line side of the central space and an operative position near the second firing line side of the central space. This extends the reach of the pipe racker significantly which is advantageous for reaching both firing lines. The reach may alternatively or additionally be increased by providing mechanisms in the form of parallelogram linkages or robotic arm structures in the pipe racker itself. The advantage of a multi-operational positions pipe racker is that it is an easier way of extending the reach of the pipe racker instead of linkages or arm structures which are often bulky elements with complex design, especially when the reach has to be extended significantly.

The first and second pipe racker may each comprise a column member supporting one or more gripping members. Movability of the first and second pipe racker may then be implemented by providing guides for the lower and upper ends of the column member along which the column member is able to move.

Alternatively, the column members of the pipe rackers may be provided on a rotary structure that is rotatable about a vertical axis, wherein a drive is provided to rotate the rotary structure about said vertical axis. The rotary structure supports at a first side thereof the first pipe racker and at a second side thereof the second pipe racker. In a first rotary position of the rotary structure, the first pipe racker is operable to move a drilling tubular between one of the storage devices and the first firing line and the second pipe racker is operable to move a drilling tubular between one of the storage devices and the second firing line. In a second rotary position of the rotary structure, the first pipe racker is operable to move drilling tubulars between one of the storage devices and the second firing line and the second pipe racker is operable to move drilling tubulars between one of the storage devices and the first firing line. In case of failure of one of the first or second pipe racker, the installation allows to rotate the rotary structure so that the still functioning pipe racker can be used in combination with each firing line. This allows to reduce the impact of the malfunction on drilling operations.

The first and second hoisting means preferably comprise a winch, an associated hoisting cable and connected to the associated hoisting cable a load connector. The load connector is preferably provided with a drilling tubulars engagement member that can engage with drilling tubulars to handle them and support the drilling tubulars from the load connector.

In an embodiment, the load connector is associated with a trolley, i.e. embodied as a travelling block, arranged to travel in vertical direction along guide elements, e.g. rails, in order to align the load connector with the respective firing line. This is especially advantageous in case the drilling installation is provided on a vessel, in which sea induced motions may cause the cables and tubular engagement member to swing out of the respective firing line if not constrained.

The guide elements for the travelling block are preferably positioned inside the corresponding framework on the side of the respective firing line that is opposite to the corresponding opening in the framework.

Preferably, the travelling block is retractable from the respective firing line in a direction away from the corresponding opening in the framework, so away from the central space, thereby allowing to move the travelling block while performing other operations in the firing line, for instance using the first or second pipe racker.

To bear the load supported by the hoisting means, the third and fourth frameworks preferably comprise vertical column members, e.g. in a square or rectangular grid, transferring the vertical load to the base of the drilling installation. Preferably, the third and fourth frameworks each comprise four vertical column members positioned around the respective firing line, preferably at corners of the framework. A vertical column member may also be part of or belong to an adjacent first or second framework.

In an embodiment, the tower comprises a storage location for additional equipment next to the first or second firing line, e.g. a blow-out preventer (BOP). In case of a BOP, the BOP is preferably moveable between the storage location and the respective firing line.

To protect the equipment, e.g. a BOP or Christmas tree, next to a framework, the protective cladding may extend away from said framework, so that the storage location of the equipment is located between the framework and the protective cladding supported by said framework. The storage location is then located inside the tower and the equipment stored in said storage location may be transported to and from the inside of the framework via a respective opening in the framework. No complex transport of the equipment needs to be carried out in this way.

In an embodiment, the protective cladding covers more than 80%, preferably more than 90% of the outer surface of the tower.

The invention also relates to a vessel comprising a drilling installation according to the invention, and to a method for drilling a well using a drilling installation according to the invention.

A vessel may be subject to sea induced motions which are undesired and especially the vertical component of the motions may cause an overload in the cables or load. The drilling installation may therefore be provided with a heave compensator for at least one of the first or second hoisting means to haul in or pay out the cables to compensate for the undesired motions of the vessel. The heave compensator is preferably located outside the tower, more preferably mounted on the outside of the tower.

The invention will now be described in a non-limiting way with reference to the accompanying drawing, wherein like reference numerals indicate like parts, and in which.

Figure 1:
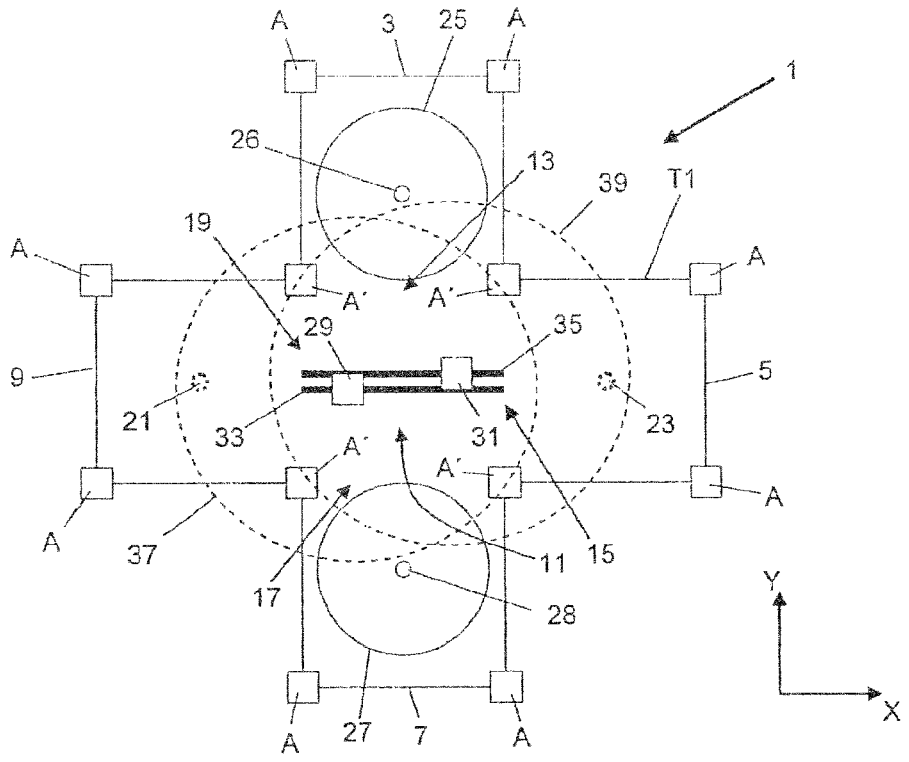
FIG. 1 depicts schematically a cross-sectional view of a drilling installation according to an embodiment of the invention.

FIG. 1 depicts schematically a cross-sectional view of a drilling installation 1 according to an embodiment of the invention. The drilling installation 1 is suitable for drilling a well, for example an oil, a gas, or a thermal well. To indicate the orientation of the cross-section, horizontal directions X and Y are shown. A vertical direction is oriented perpendicular to both the X and Y directions.

The installation 1 comprises a tower T1 with four frameworks 3, 5, 7, 9 arranged around a central space 11 of the tower T1. The first and second frameworks 3 and 7 form a pair of opposing frameworks, as do third and fourth frameworks 5 and 9. As the central space here is rectangular, the orientation of the pair of opposing frameworks 3 and 7 is rotated about 90 degrees about a vertical axis with respect to the orientation of the other pair of opposing frameworks 5,9. As mentioned before, said vertical axis is perpendicular to the X and Y directions as shown in FIG. 1.

Each framework 3, 5, 7, 9 has an opened vertical side with a respective opening 13, 15, 17, 19 that is large enough to allow passage of drilling tubulars in vertical orientation as will be explained below. These opened sides with openings face towards the central space 11.

The installation 1 further comprises first hoisting means (not shown) adapted to manipulate drilling tubulars in a vertically extending first firing line 21, and second hoisting means (not shown) adapted to manipulate drilling tubulars in a vertically extending second firing line 23. For example these hoisting means each include one or more winches, pulleys and a drill string attachment member or other load connector member.

The first and second firing line 21, 23 are arranged inside one pair of opposing third and fourth frameworks 5, 9, such that each framework of said pair of opposing frameworks houses a firing line.

Drilling tubulars may be vertically stored in a first storage device 25 and/or in a second storage device 27. Preferably said storage device allow storage of multi-joint tubulars, e.g. double or triple drill pipe joints having a length of about 20 or 30 meters, or possibly quad-joints.

In this embodiment, both storage devices are rotatable about a respective vertical axis 26, 28.

The first and second storage devices 25, 27 are arranged inside one pair of opposing frameworks 3, 7, such that each framework of said pair of opposing frameworks houses such a storage device.

To move drilling tubulars between the first or second storage device 25, 27 and the first firing line 21, a first pipe racker 29 is provided, and to move drilling tubulars between the first or second storage device 25, 27 and the second firing line 23, a second pipe racker 31 is provided. The first and second pipe racker are arranged inside the central space 11.

By providing the pipe rackers in the central space in the tower and distribute the storage devices and firing lines around the pipe rackers a drilling installation is provided which makes efficient use of the space and can easily be embodied redundant with respect to failure of one of the storage devices and/or pipe rackers.

In this embodiment, the first and second pipe racker 29, 31 are moveable along respective horizontal tracks 33, 35 between the first firing line side and the second firing line side of the central space 11, so as to reach the respective firing line. This increases the level of redundancy.

Not shown are gripper assemblies that commonly form part of the first and second pipe rackers. Instead the maximum reach of the pipe rackers for the positions shown are indicated by dashed circles 37, 39. As shown in FIG. 1, both pipe rackers are able to reach into both pipe storage devices. Further, by moving between the first firing line side and the second firing line side of the central space, the pipe rackers are able to service both firing lines. It is even possible to transfer a drilling tubular directly between the two firing lines using one of the pipe rackers.

Not shown in FIG. 1 is that, the frameworks, i.e. the tower T1, may support a weather protective cladding to protect the first and second firing line, the first and second storage device, and the central space from environmental weather conditions.

Each framework 3, 5, 7, 9 in this example has four vertical load bearing columns A, A'. Two of these columns indicated by reference A' are shared by adjacent frameworks, and the other two vertical columns A belong only to the corresponding framework. The vertical columns A, A' are interconnected by bars, i.e. a truss to form a rigid framework. As a result, the cross sectional view of a framework at the height of an opening has a U-shape.

Figure 2:
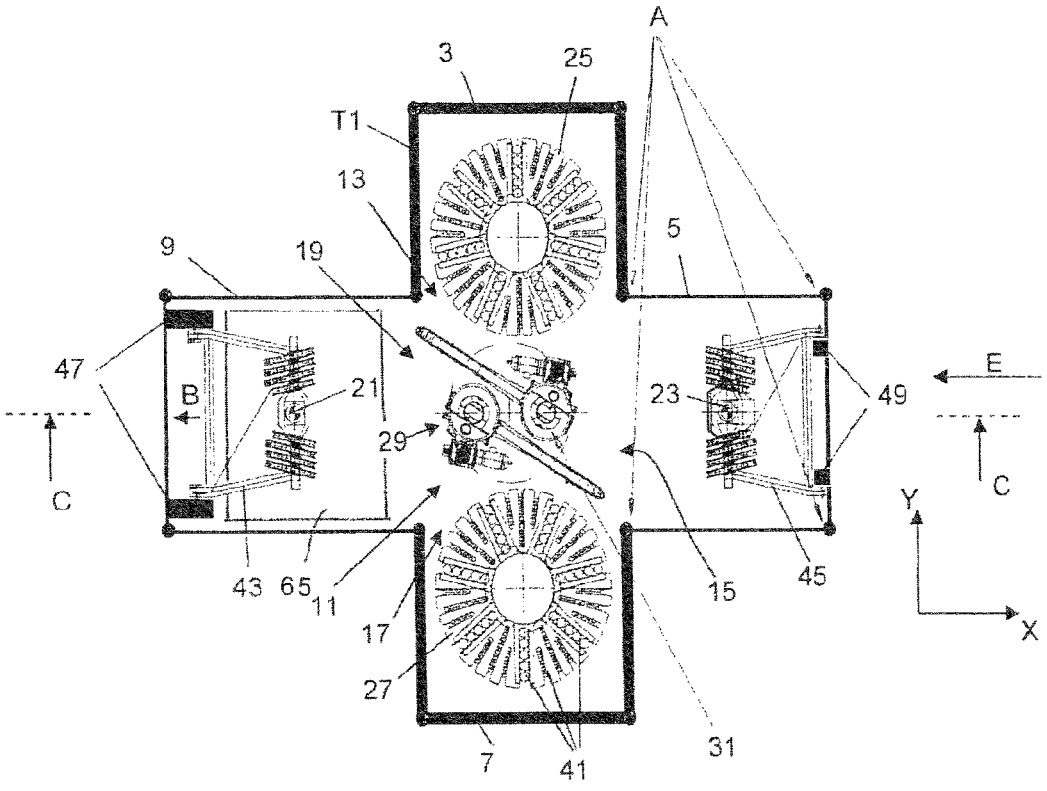
FIG. 2 depicts schematically a cross-sectional view of a drilling installation according to another embodiment of the invention.

FIG. 2 depicts in more detail a schematic cross sectional view of a drilling installation 1 according to another embodiment of the invention. Again the horizontal directions X and Y are indicated as a reference.

The drilling installation 1 comprises a tower T1 with four frameworks 3, 5, 7, 9 arranged around a central space 11 of the tower T1, such that two pairs of opposing frameworks are defined. An orientation of one pair of opposing frameworks 3, 7 is rotated about 90 degrees about a vertical axis with respect to an orientation of the other pair of opposing frameworks 5, 9, wherein each framework has an opening 13, 15, 17, 19 that is large enough to allow passage of vertically held drilling tubulars 41, said opening facing towards the central space 11.

The drilling installation further comprises first hoisting means adapted to manipulate drilling tubulars in a first firing line 21, and second hoisting means adapted to manipulate drilling tubulars in a second firing line 23.

Each of the first and second hoisting means here comprise a respective travelling block with trolley 43,45 that is guided by respective vertical guide rails 47, 49 mounted to the corresponding framework 5, 9, here to a planar side thereof as is preferred. The guide rails 47,49 here are positioned on a side of the respective first and second firing line 21, 23 that is opposite to the corresponding opening 19,15 of frameworks 9,5, so that the travelling block 43,45 are positioned between the respective guide rails and firing lines.

The guide rails 47 in framework 9 are adapted to allow the retraction of the travelling block and trolley 43 in a direction away from the first firing line 21 as indicated by arrow B. This allows for moving the travelling up and down while the respective firing line is free to be operated in by another component such as a pipe racker.

The drilling installation 1 further comprises a first storage device 25 for vertically storing drilling tubulars 41, a second storage device 27 for vertically storing drilling tubulars, a first pipe racker 29 for moving drilling tubulars between the first or second storage device 25, 27 and the first firing line 21, and a second pipe racker 31 for moving drilling tubulars between the first or second storage device and the second firing line 23.

Vertical forces on the first and second hoisting means due to loads suspended from the first and second hoisting means are borne here mainly by four vertical columns A which are part of the corresponding framework. The four vertical columns are indicated in FIG. 2 for framework 5 only, but the same applies to framework 9.

Figure 3:
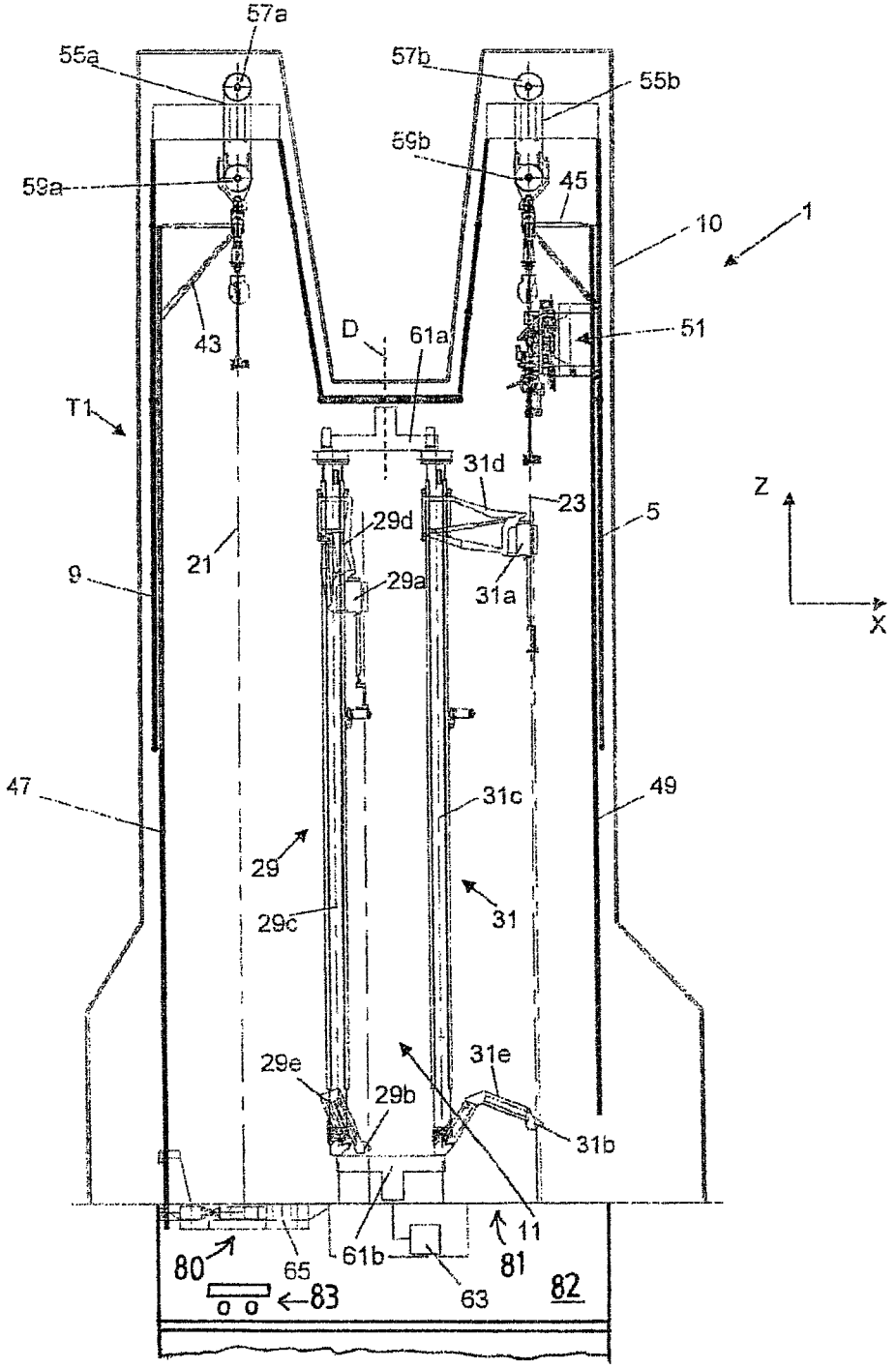
FIG. 3 depicts schematically another cross-sectional view of the drilling installation according to FIG. 2.

FIG. 3 depicts another cross sectional view of the drilling installation of FIG. 2 as indicated by the arrows C in FIG. 2. For clarity reasons, not all parts are shown or not entirely shown in FIG. 3.

Shown in FIG. 3 are a portion of the frameworks 5, 9 comprising respectively the first and second firing line 21, 23. Also shown are the guide rails 47, 49 along which travelling blocks 43 and 45 can travel in a vertical direction indicated by arrow Z. The travelling blocks are shown in their top position but can travel to a bottom position to e.g. lower equipment or a drill string.

The travelling blocks are suspended from the framework by a respective hoisting cable 55*a*, 55*b* which run over respective sheaves 57*a*, 57*b* mounted on the framework and respective sheaves 59*a*, 59*b* mounted on the travelling block. Not shown is that the hoisting cables 55*a*, 55*b* can be hauled in and paid out by a corresponding winch.

Also shown in FIG. 3 are the first and second pipe rackers 29, 31, although they are shown in a slightly different position with respect to FIG. 2. The first and second pipe racker are here positioned on opposite sides of a rotary structure that is rotatable about a vertical axis D (parallel to the Z direction) and has a corresponding drive 63 to rotate the rotary structure about said vertical axis D.

The first and second pipe rackers are preferably of the same design.

Each pipe racker includes one or more moveable gripping members 29*a*, 29*b*, 31*a*, 31*b* adapted to grip a tubular to be removed from a storage device of placed in said storage device.

In this example, as is known from the prior art, the first and second pipe racker each include a first and second vertical column 29*c*, 31*c*, respectively, said column member each supporting said on or more gripping members. In this example, each column member supports multiple, here two, gripping members 29*a*, 29*b*, 31*a*, 31*b*. In this example, and as is also known from the prior art, each gripping member is mounted on a motion device, here an articulated arm 29*d*, 29*e*, 31*d*, 31*e*, allowing to displace the gripping member within a reach outside of the column member.

Some or all gripping members may be vertically displaceable along the column member, e.g. by an associated cable and winch, in order to adjust the height position of the gripping members to the tubulars to be handled.

As is also known from the prior art, and not shown, a drive motor is associated with each column member allowing to pivot the column member about its vertical axis, thereby moving the gripping members and any tubular held by said gripping members.

As can be seen in FIG. 3 the first and second vertical column member are mounted on the rotary structure with a space between said first and second vertical column members.

In this example, the rotary structure includes a base member 61*b* to which the column members are connected with their lower end and a top member 61*a* to which the column members are connected with their upper end. The top member 61*a* here is connected to a roof structure above the central space, said roof structure bridging the top ends of the first and second frameworks.

As the pipe rackers and pipe storage devices are of less height than the height required at a firing line within the tower, it is envisaged that the third and fourth frameworks stand taller than the first and second frameworks.

By rotation of the rotary structure, the pipe rackers are moveable between a first firing line side of the tower and a second firing line side of the tower and can also be combined with the other storage device. This allows for any combination between storage device, pipe racker and firing line, so that in case on pipe racker fails, the other pipe racker can take over.

Also shown in FIG. 3 is a vertically mobile working floor 65 that is adapted to support equipment, e.g. an iron roughneck, and people around the first firing line 21, e.g. to allow for interconnecting a new drilling tubular to a launched tubulars string or during tripping.

As is preferred the floor 65 includes an opening for the passage of a string of tubulars extending in the firing line.

The working floor 65 here is moveable in vertical direction along guide rails 47 which extend inside the framework 9. By positioning the working floor at a raised, preferably non-operative, position, equipment such as a BOP or a christmas tree can be inserted into the first firing line below the raised working floor. Alternatively, the working floor may be guided by other vertical elements, possibly the vertical column members of the corresponding framework.

The working floor 65 in its operative, lowered position, covers a moonpool opening 80 in a vessel.

In FIG. 3 a second moonpool opening 81 is present at the side of the other firing line. A mobile hatch or hatches (displaceable in horizontal direction) may be provided or yet another vertically mobile working floor. Even a fixed floor may be provided, e.g. if a vertically mobile floor is present at the side where the BOP is handled and stored.

The one or more moonpool openings may lead to a moonpool 82 wherein preferably a mobile cart 83 is arranged allowing to suspend a string of tubulars from said mobile cart 83 and allowing to transfer said suspended string of tubulars from one firing line to the other firing line.

Suspended from the travelling block 45 is equipment 51 that in this case is a top drive that can be used to drive a drill string. Preferably, the top drive is also guided vertically similar to the travelling block.

The frameworks support a weather protective cladding 10 arranged on the outside of the tower T1 to protect the first and second firing line 21, 23, the first and second storage device, and the central space 11 from environmental weather conditions. This protective cladding is not shown in FIG. 2 for clarity reasons.

The tower structure here is higher at the frameworks 5, 9 than at the central space 11 which allows to accommodate part of the first and second hoisting means. As shown in FIG. 3, the travelling blocks 43, 45 and equipment 51 can be brought to an elevation such that tubular drill strings can easily be introduced beneath them into the respective firing line.

Figure 4:
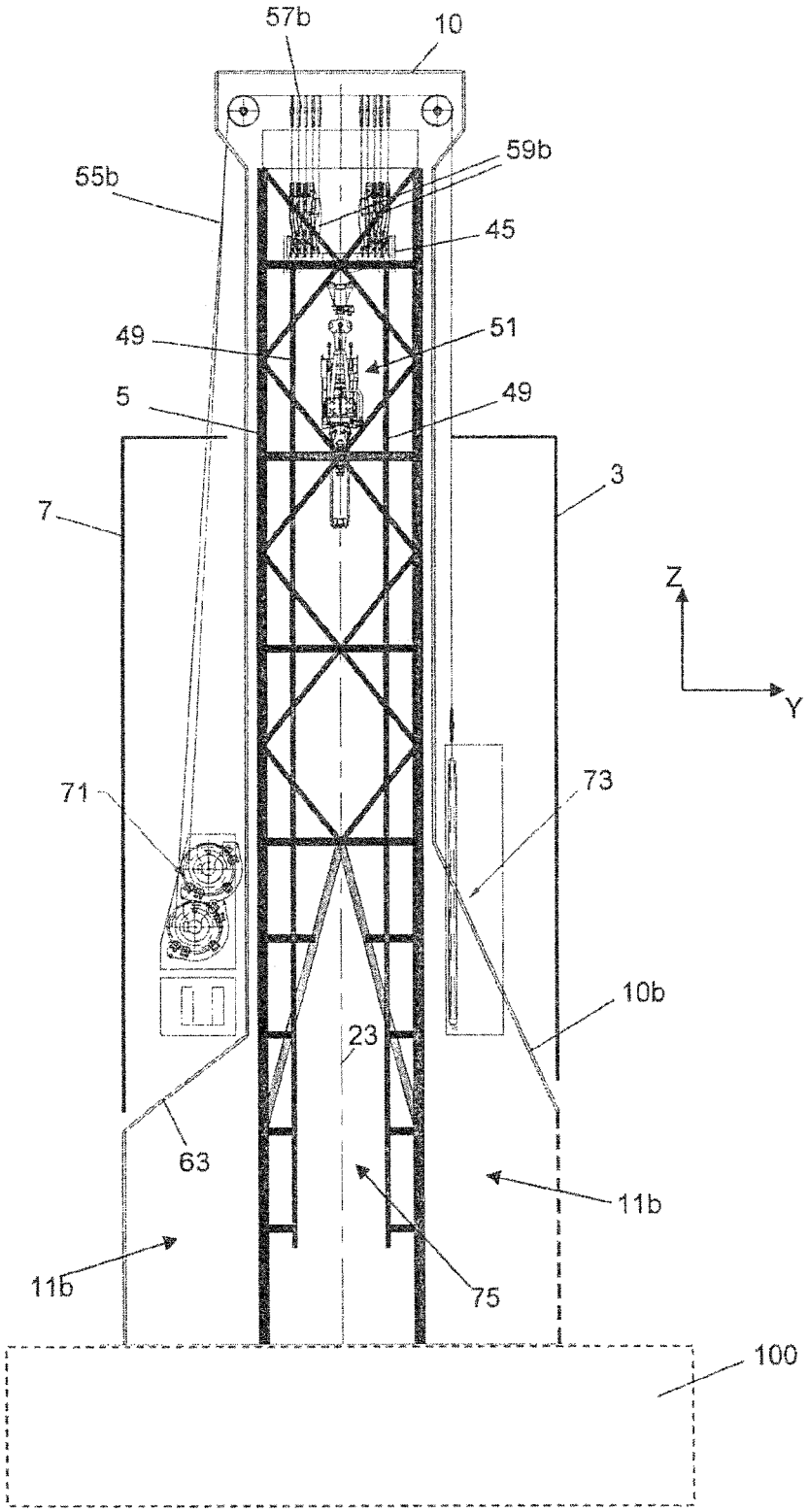
FIG. 4 depicts a side view of the drilling installation of FIG. 2.

FIG. 4 depicts a side view of the drilling installation according to arrow E in FIG. 2. Shown is the framework 5 comprising the second firing line 23. The protective cladding 10 on framework 5 that extends in plane of the drawing is not shown to show the interior of framework 5.

FIG. 4 further shows the outer contour of the frameworks 3 and 7. As clearly depicted, the frameworks 3,7 are smaller in height than the framework 5. This is mainly caused by the hoisting means which are provided at the top of the framework 5 and require more space.

At the bottom of the framework, the weather protective cladding 10 extends away from the framework 5 as indicated by cladding portion 10*a* and 10*b*. This allows to protect a space 11*b* from weather conditions next to the framework 5, so that for instance equipment can be stored next to the firing line and still be protected by the protective cladding. In the framework one or more so-called V-doors 75 can be provided for transportation of equipment, tubulars, etc. from or to the firing line.

The hoisting means comprise a winch 71 which is arranged outside the tower, in this example on the outside of the tower. The winch is configured to haul in and pay out the hoisting cable 55*b*. Suspended by the cable 55*b* is the travelling block 45 with sheaves 59*b*. Also connected to the cable 55*b* is a heave compensator 73 which hauls in or pays out the cable 55*b* to compensate for undesired vessel motions of a vessel 100 on which the drilling installation may be placed and which is shown schematically by the dashed box 100. The heave compensator is also provided on the outside of the tower. Supported by the travelling block is equipment, e.g. a top drive, 51.

The invention claimed is:

1. A dual firing line drilling installation for drilling a well, comprising:

a drilling tower main structure having four frameworks that are each over a major portion of their height U-shaped in horizontal cross-section, so that each of said frameworks has an opened vertical side, wherein a four-sided central space is present in the tower, and wherein along each side of the central space one of said four frameworks is arranged with opened vertical sides thereof facing the central space, the frameworks being interconnected to form said drilling tower main structure;

a first storage device for vertically storing drilling tubulars, said first storage device being housed in a first framework of the drilling tower main structure;

a second storage device for vertically storing drilling tubulars, said second storage device being housed in a second framework of the drilling tower main structure which is located generally opposite from the first framework of the drilling tower main structure;

a first hoisting device supported by a third framework of the drilling tower main structure, said first hoisting device being adapted to manipulate a string of drilling tubulars in a first firing line extending vertically within said third framework;

a second hoisting device supported by a fourth framework of the drilling tower main structure, said fourth framework being located generally opposite from the third framework of the drilling tower main structure, and said second hoisting device being adapted to manipulate a string of drilling tubulars in a second firing line extending vertically within said fourth framework;

a first pipe racker housed within the drilling tower main structure and adapted to move drilling tubulars while supported in vertical orientation between at least one of the storage devices and at least the first firing line via said opened vertical sides of the respective frameworks; and a second pipe racker housed within the drilling tower main structure and adapted to move drilling tubulars while supported in vertical orientation between at least the second storage device and at least the second firing line via said opened vertical sides of the respective frameworks.

2. The installation according to claim 1, wherein the first and second pipe racker are arranged in the central space.

3. The installation according to claim 1, wherein the first pipe racker is configured to move drilling tubulars while in vertical orientation between each of the first and second storage devices and each of the first and second firing lines, and wherein the second pipe racker is configured to move drilling tubulars while in vertical orientation between each of the first and second storage devices and each of the first and second firing lines.

4. The installation according to claim 1, wherein the first and second framework have a height that is less than the height of the third and fourth framework, and wherein a roof structure above the central space bridges the top ends of the first and second frameworks.

5. The installation according to claim 1, wherein at least one of the third and fourth frameworks is provided with a vertically movable working floor having an opening therein for the string of drilling tubulars in the respective firing line.

6. The installation according to claim 5, wherein the framework is provided with vertical guide elements to guide the vertically movable working floor.

7. The installation according to claim 1, wherein at least one of the third and fourth frameworks is provided with one or more vertical guide elements and one or more trolleys that are movable along said guide elements, said one or more trolleys supporting a topdrive for rotary drive of a string of drilling tubulars and/or a travelling block for attaching a string of drilling tubular to the respective hoisting device.

8. The installation according to claim 6, wherein the third and fourth framework each have a planar vertical side opposite the opened vertical side, and wherein the one or more vertical guide elements are mounted on said planar vertical side.

9. The installation according to claim 1, wherein the drilling tower main structure supports a weather protective cladding on its exterior to protect the work space near the first and second firing line, the first and second storage devices, and the central space from environmental weather conditions.

10. The installation according to claim 9, wherein the first and second hoisting devices each comprise a winch that is located in a separate room remote from the workspace near the first and second firing lines and the central space.

11. The installation according to claim 1, wherein at least one of the third and fourth framework has a V-door opening to allow for the passage of drilling tubulars.

12. The installation according to claim 1, wherein the first and second storage devices are rotary storage devices.

13. The installation according to claim 1, wherein the first and second pipe rackers are moveably mounted in the drilling tower main structure, so as to have a first firing line operative position near the third framework so as to reach the first firing line, and a second firing line operative position near the fourth framework so as to reach the second firing line.

14. The installation according to claim 13, wherein the first and second pipe rackers are mounted in a rotary pipe rackers structure arranged in the central space, said rotary pipe rackers structure allowing to bring each of the pipe rackers to a selected operative position.

15. The installation according to claim 13, wherein each pipe racker is translatory movable along one or more associated tracks allowing to bring each of the pipe rackers in a selected operative position.

16. The installation according to claim 7, wherein at least one trolley is provided with a travelling block, and wherein said trolley is movable to a retracted position away from the respective firing line.

17. The installation according to claim 1, wherein each of the third and fourth frameworks comprises at least four vertical columns that are adapted to bear vertical loads resulting from the associated hoisting devices.

18. The installation according to claim 1, wherein the tower main structure comprises at least one storage space for additional equipment next to the first or second firing line.

19. The installation according to claim 9, wherein the tower main structure comprises at least one storage space for additional equipment next to the first or second firing line, and the at least one storage space is located between the framework associated with said firing line and the protective cladding supported by said framework.

20. An offshore drilling vessel comprising a drilling installation according to claim 1.

21. The vessel according to claim 20, wherein the vessel has a first and second moonpool opening on opposed sides of a floor of the central space, said moonpool openings serving respectively to allow for passage of string of drilling tubulars or other equipment along the first and second firing lines, respectively.

22. The installation according to claim 2, wherein each pipe racker includes a vertical column member supporting one or more gripping members.

23. The installation according to claim 5, wherein said working floor is movable between a lowered and a raised position that are at least 5 meters apart.

24. The installation according to claim 6, wherein the vertical guide elements to guide the vertically movable working floor are rails.

25. The installation according to claim 7, wherein the vertical guide elements to guide the one or more trolleys are rails.

26. The installation according to claim 12, wherein the first and second storage device are rotary storage devices with a central rotatable vertical column and one or more fingerboards supported by the column, as well as with a drive motor for rotating the rotary storage device.

27. The installation according to claim 15, wherein each pipe racker is translatory movable along a lower track and a top track at respectively the lower end and the top end of the pipe racker.

28. The installation according to claim 16, wherein said trolley is movable to a retracted position away from the respective firing line while supporting the travelling block.

29. The installation according to claim 17, wherein the at least four vertical columns are arranged in a rectangular arrangement.

30. The installation according to claim 18, wherein the tower main structure comprises at least a storage space for a blow-out preventer (BOP).

31. The vessel according to claim 21, wherein said moonpool openings lead to a common moonpool of the vessel.

32. The vessel according to claim 31, wherein a mobile cart is arranged in said common moonpool allowing to suspend a string of tubulars from said mobile cart and allowing to transfer said suspended string of tubulars from one firing line to the other firing line.

33. A method of drilling a well, comprising the step of using an offshore drilling vessel comprising a dual firing line drilling installation, the dual firing line drilling installation comprising:

a drilling tower main structure having four frameworks that are each over a major portion of their height U-shaped in horizontal cross-section, so that each of said frameworks has an opened vertical side, wherein a four-sided central space is present in the tower, and wherein along each side of the central space one of said four frameworks is arranged with opened vertical sides thereof facing the central space, the frameworks being interconnected to form said drilling tower main structure;

a first storage device for vertically storing drilling tubulars, said first storage device being housed in a first framework of the drilling tower main structure;

a second storage device for vertically storing drilling tubulars, said second storage device being housed in a second framework of the drilling tower main structure which is located generally opposite from the first framework of the drilling tower main structure;

a first hoisting device supported by a third framework of the drilling tower main structure, said first hoisting device being adapted to manipulate a string of drilling tubulars in a first firing line extending vertically within said third framework;

a second hoisting device supported by a fourth framework of the drilling tower main structure, said fourth framework being located generally opposite from the third framework of the drilling tower main structure, and said second hoisting device being adapted to manipulate a string of drilling tubulars in a second firing line extending vertically within said fourth framework;

a first pipe racker housed within the drilling tower main structure and adapted to move drilling tubulars while supported in vertical orientation between at least one of the storage devices and at least the first firing line via said opened vertical sides of the respective frameworks; and a second pipe racker housed within the drilling tower main structure and adapted to move drilling tubulars while supported in vertical orientation between at least the second storage device and at least the second firing line via said opened vertical sides of the respective frameworks, the step of using the offshore drilling vessel further comprising the steps of:

vertically storing drilling tubulars in the first framework of the drilling tower main structure by using the first storage device;

vertically storing drilling tubulars in the framework of the drilling tower main structure by using the second storage device;

manipulating a first string of drilling tubulars in the first firing line by using the first hoisting device;

manipulating a second string of drilling tubulars in the second firing line by using the first hoisting device;

moving drilling tubulars between at least one of the first and second storage devices and at least the first firing line by using the first pipe racker; and moving drilling tubulars between at least the second storage device and at least the second firing line by using the second pipe racker.

* * * * *